US006497496B2

(12) United States Patent
Wang

(10) Patent No.: US 6,497,496 B2
(45) Date of Patent: Dec. 24, 2002

(54) TUBULAR LIGHT

(76) Inventor: Jessica Wang, 16F-3, No. 70, Sec. 2, Tun Ha South Road, Taipei (TW)

( * ) Notice: Subject to any disclaimer, the term of this patent is extended or adjusted under 35 U.S.C. 154(b) by 0 days.

(21) Appl. No.: 09/990,828

(22) Filed: Nov. 14, 2001

(65) Prior Publication Data

US 2002/0030990 A1 Mar. 14, 2002

Related U.S. Application Data

(63) Continuation-in-part of application No. 09/661,004, filed on Sep. 13, 2000.

(51) Int. Cl.[7] ..... F21W 121/00; F21Y 101/00

(52) U.S. Cl. ..... 362/249; 362/250; 362/227; 362/252

(58) Field of Search ..... 362/121, 227, 362/249, 250, 252, 240, 806, 807

(56) References Cited

U.S. PATENT DOCUMENTS 4,607,317 A * 8/1986 Lin ..... 362/250
4,943,900 A * 7/1990 Gartner ..... 362/227
5,934,792 A * 8/1999 Camarota ..... 362/249
6,186,645 B1 * 2/2001 Camarota ..... 362/249
6,217,194 B1 * 4/2001 Huang ..... 362/249
6,244,726 B1 * 6/2001 Fan Wong ..... 362/249
6,265,834 B1 * 7/2001 Lin ..... 362/249
6,394,623 B1 * 5/2002 Tsui ..... 362/252
6,428,342 B1 * 8/2002 Pan ..... 362/252

* cited by examiner

*Primary Examiner*—Laura K. Tso

(57) ABSTRACT

A tubular light has a hollow core 40, multiple light bulbs 50 and two wires 60. The core 40 has a pair of opposed notches 41 defined along the length of the core 40. Each of the notches 41 has a plurality of blind holes 411 defined in a bottom defining the notch 41. The hollow core 40 further has two slits 412 each oppositely defined along one of the notch 41. Each of the light bulbs 50 is received in one of the blind holes 412 with one blind hole 411 spaced apart and has two connection wires 51 extending toward opposite directions. Furthermore, the periphery of the casing 70 that covers the core 40, the light bulbs 50, the wires 60 in a water tight manner is polygonal so as to increase the refraction of the light from the tight bulbs 50 and penetrating through the casing 70.

6 Claims, 8 Drawing Sheets

TUBULAR LIGHT

CROSS REFERENCE

The application is a continuation in part of 09/661,004 filed on Sep. 13, 2000 by the same applicant of this application. The content of the co-pending application is now taken for reference.

FIELD OF THE INVENTION

The present invention relates to a tubular light, and more particularly to a tubular light made of transparent and resilient material. The tubular light has a tubular body with two diametrically opposed notches peripherally defined to receive therein multiple light bulbs that are located in blind holes in a bottom defining each of the notches and two slits defined along opposed side face of one of the notch to receive wire. Furthermore, a resilient element is received in the tubular body so as to enable the user to form the tubular light into any form.

BACKGROUND OF THE INVENTION

Tubular light is a light that a user uses as an exterior decoration. Due to the material used to made the light being transparent and resilient, the user can use it in almost every parts of the surroundings. One example is that users often use the tubular light to decorate the roof, which increases the atmosphere especially at nighttime. A conventional tubular light is shown in FIGS. 7 and 8, which has a cylindrical solid core 10 with two diametrically opposed notches 11 and multiple light bulbs 20 each received in a corresponding one of blind holes 111 defined in the bottom defining each of the notches 11 and having two connecting wires 21 to electrically connect with other light bulb 20. Each of the light bulbs 20 is received in the corresponding blind hole 111 with one blind hole 111 spaced between every two adjacent light bulbs 20. When the light bulbs 20 are received in the blind holes 111, two adjacent connecting wires 21 are tangled together to form a joint (not numbered) to be received in the blind hole 111 between two adjacent light bulbs 20 as shown in FIG. 8. Afterwhich, electrical wires 22 are peripherally located on the core 10 and in parallel to the notch 11. Then, a casino 30 made of transparent material is integrally molded outside the core 10 to surround the core 10 in an air tight manner such that the light from the light bulbs 20 are visible from outside of this tubular light.

This kind of tubular light does meet the requirements of the user. However, the electrical wires 22 are protruding out from the periphery of the core 10, which makes the periphery of the casing 30 not smooth. Furthermore, the periphery of the casing 30 is substantially cylindrical, which makes the refraction of the light from the light bulbs 20 dull and plain.

The present invention provides an improved tubular light to overcome the above mentioned shortcomings.

SUMMARY OF THE INVENTION

The primary objective of the invention is to provide an improved tubular light having two slits defined along the notches of the hollow core to receive the electrical wires, such that when the casing is molded outside the hollow core, the outer periphery of the casing is smooth.

Another objective of the invention is to provide a polygonal casing integrally formed outside the hollow core to increase the refraction of the light from the light bulbs.

Still, another objective of the invention is to provide a tubular light with a resilient element embedded in the tubular body so as to enable the user to form the tubular light into any form required.

Other objects, advantages and novel features of the invention will become more apparent from the following detailed description when taken in conjunction with the accompanying drawings.

DETAILED DESCRIPTION TO THE INVENTION

Figure 1:
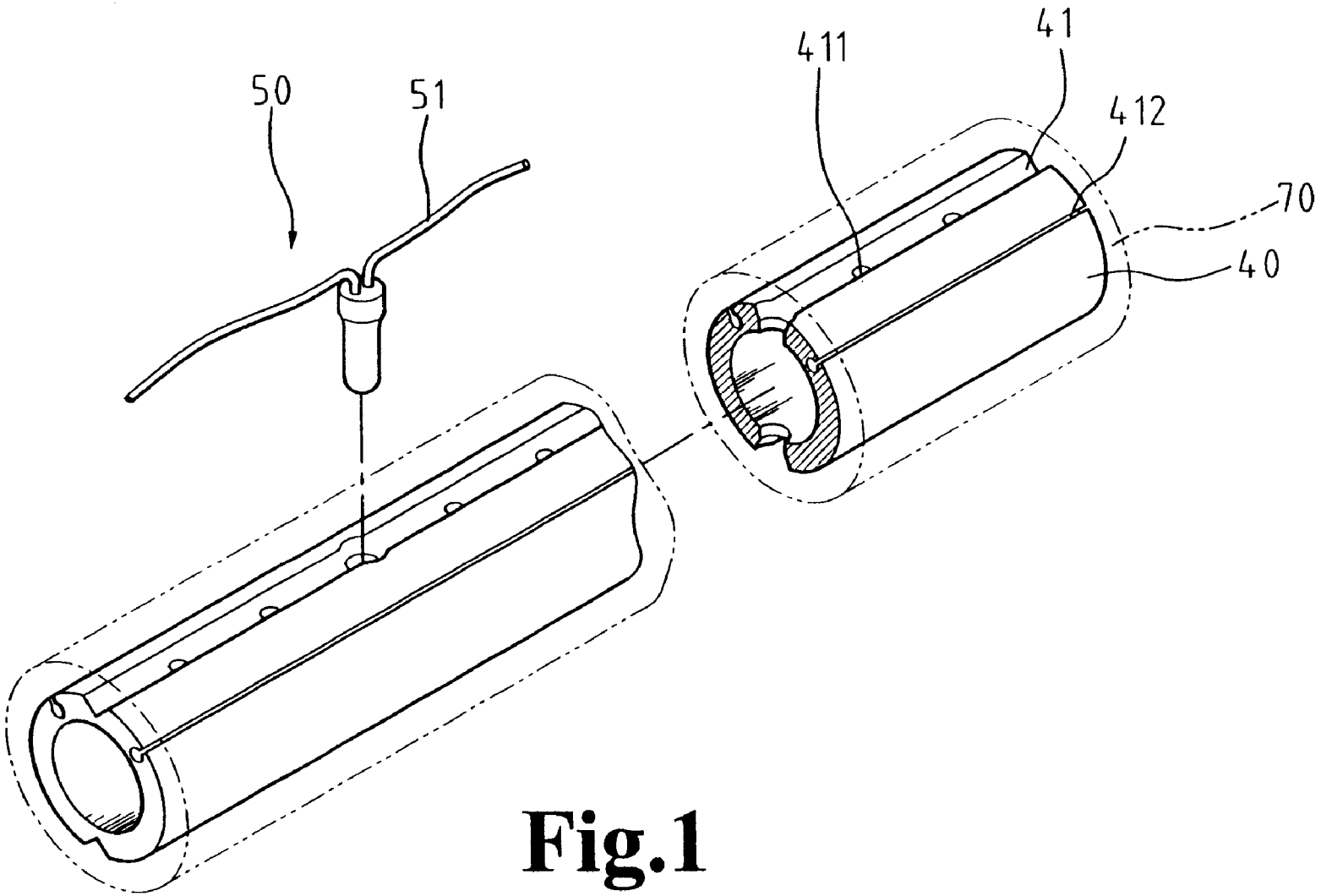
FIG. 1 is an exploded perspective view showing the tubular light of the invention.
Figure 2:
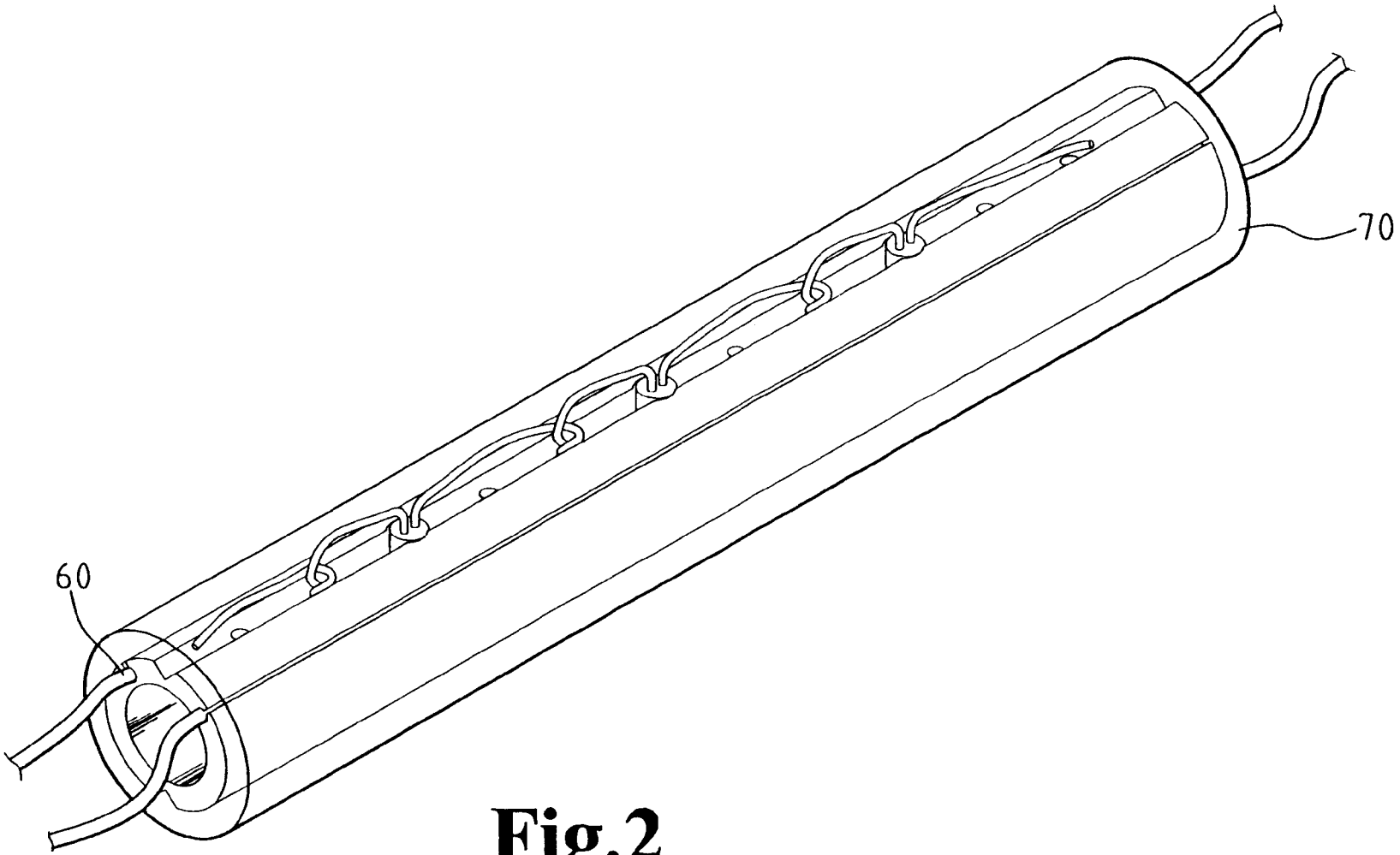
FIG. 2 is a perspective view of the assembled tubular tight constructed in accordance with the present invention.

With reference to FIGS. 1, and 2, a tubular light constructed in accordance with the present invention has a hollow core 40, multiple light bulbs 50 and two wires 60.

The hollow core 40 is colored when made. The core 40 has a pair of opposed notches 41 defined along the length of the core 40. Each of the notches 41 has a plurality of blind holes 411 defined in a bottom defining the notch 41. The hollow core 40 further has two slits 412 each oppositely defined in opposite sides of one of the notches 41.

Each of the light bulbs 50 is received in one of the blind holes 412 with one blind hole 411 spaced apart and has two connection wires 51 extending toward opposite directions.

When the tubular light of the invention is assembled, the light bulbs 50 are received in the blind holes 411 and every two adjacent light bulbs (50) are spaced apart from each other by a blind hole 411. After all the light bulbs 50 are received in the corresponding blind holes 411, every two adjacent connection wires 51 of two adjacent light bulbs 50 are securely connected with one another. The joint of two adjacent connection wires 51 is then inserted into the blind hole 411 between two adjacent light bulbs 50. Afterwhich, the two wires 60 are respectively received in one of the two slits 412. Due to the slits 412, the overall periphery of the hollow core 40 is smooth. When all the light bulbs 50 are properly connected and received in the hollow core 40, a casing 70 made of transparent material is molded outside of the hollow core 40 to enclose the hollow core 40, the light bulbs 50 and the two wires 60 in a water-tight manner.

Figure 3:
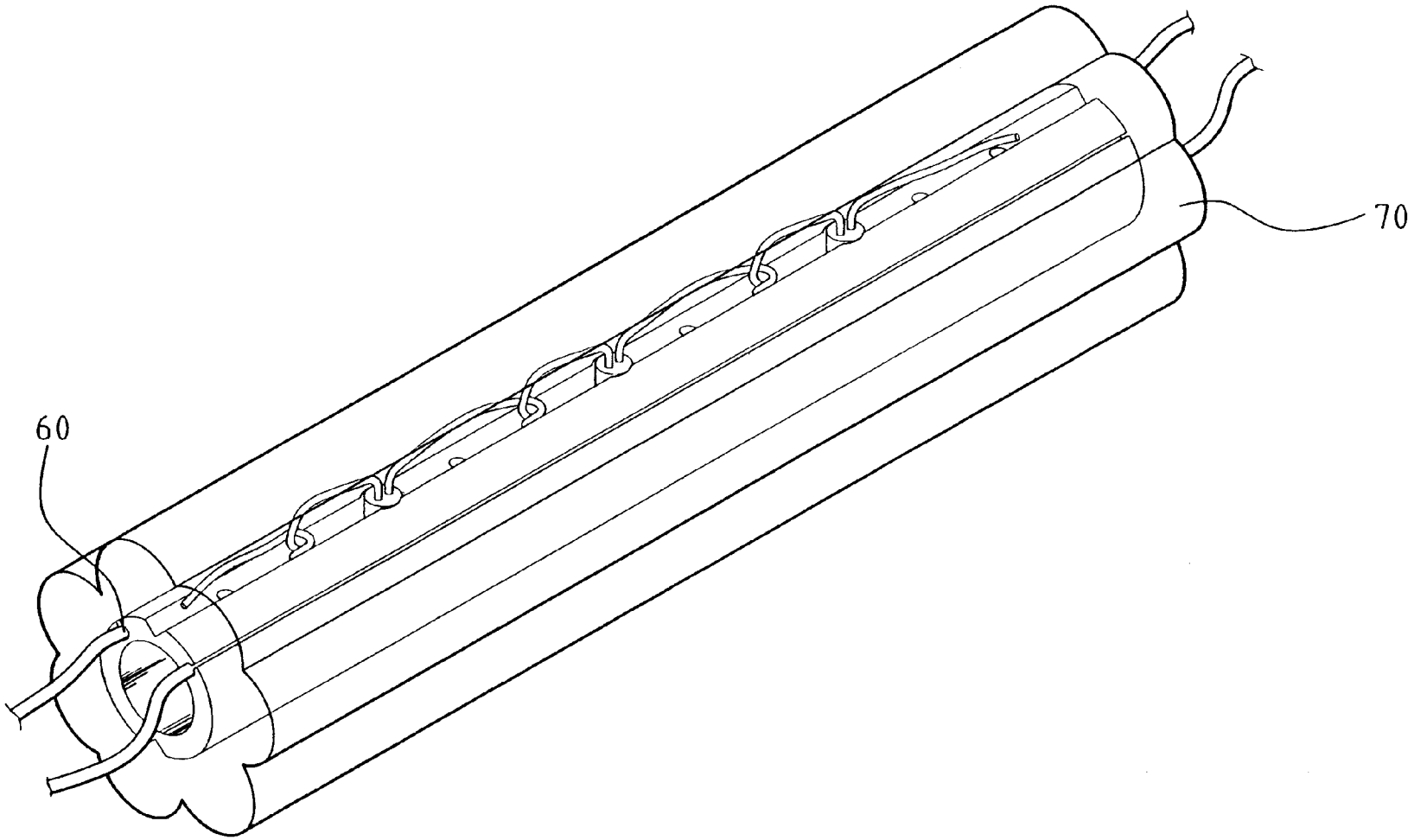
FIG. 3 is a perspective view of one preferred embodiment of the invention.
Figure 4:
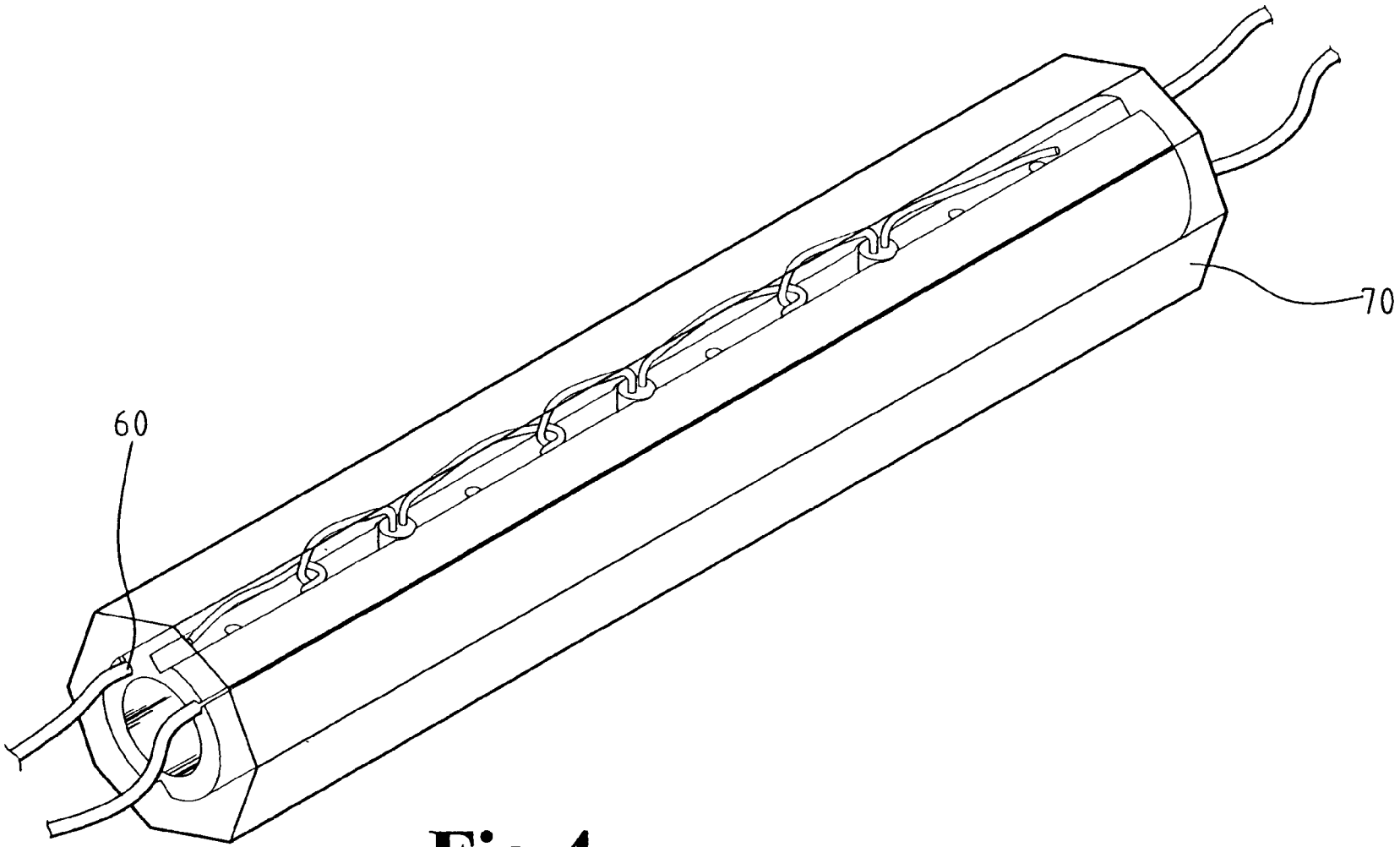
FIG. 4 is a perspective view of still another preferred embodiment of the invention.

Because the casing 70 is made of a transparent material, the light from the light bulbs 50 are able to penetrate through the casing 70 and light the surroundings. It is noted that to increase the refraction of the light of the light bulbs 50 penetrating through the casing 70, the periphery of the casing 70 has a continuous and undulated shape, as shown in FIG. 3. In FIG. 4, the periphery of the casing 70 is polygonal.

Figure 5:
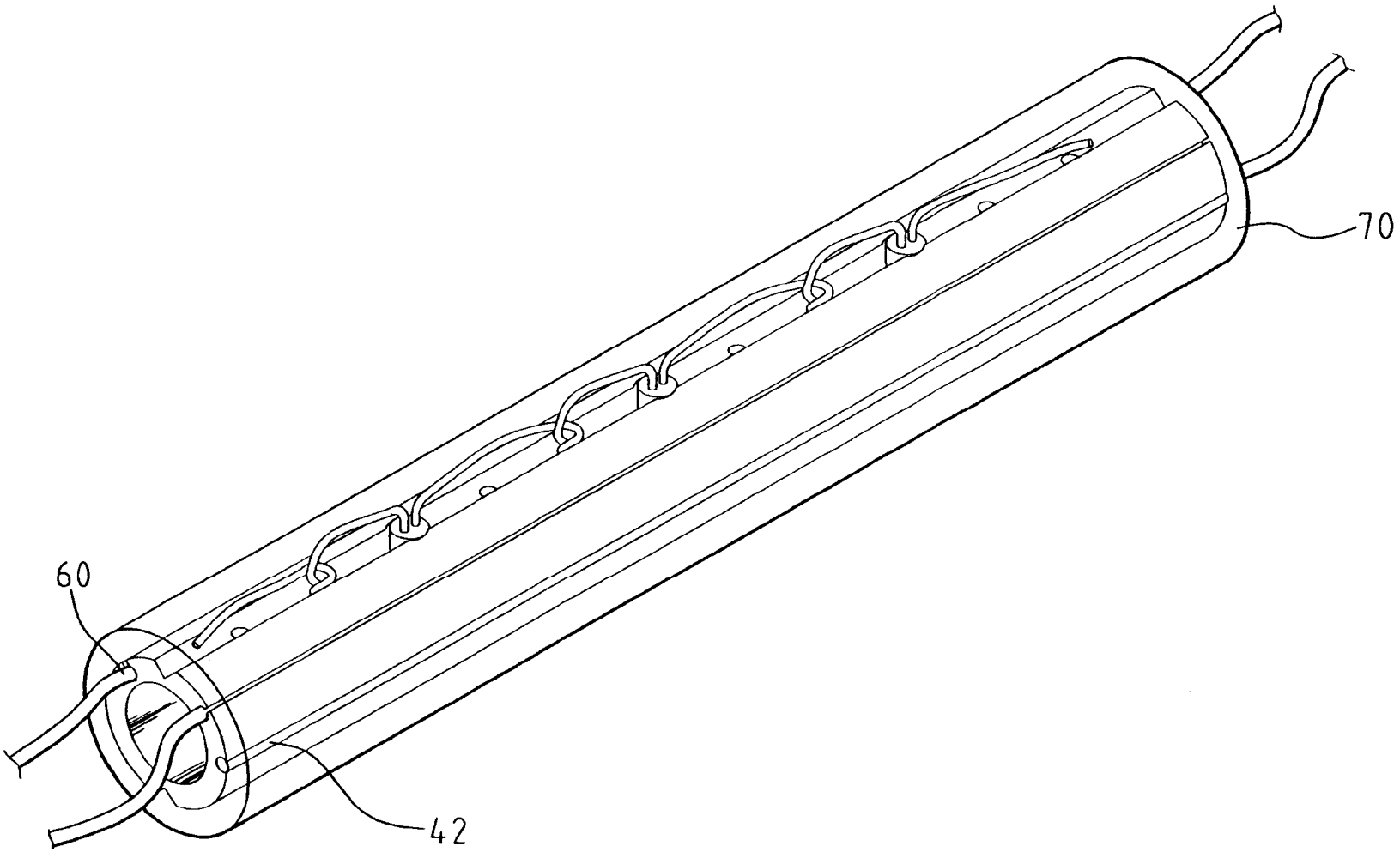
FIG. 5 is a perspective view of another embodiment of the tubular light o f the present invention.
Figure 6:
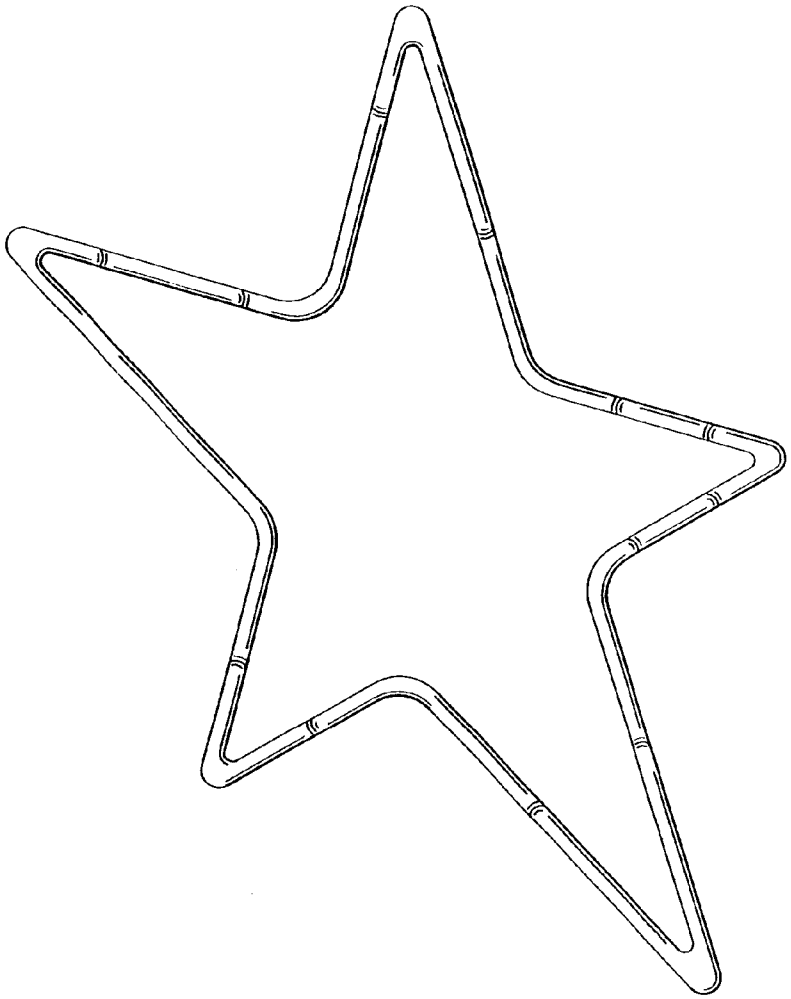
FIG. 6 is a perspective view of the embodiment in FIG. 5, wherein with the resilient element, the tubular light is able to be formed into any form required.
Figure 7:
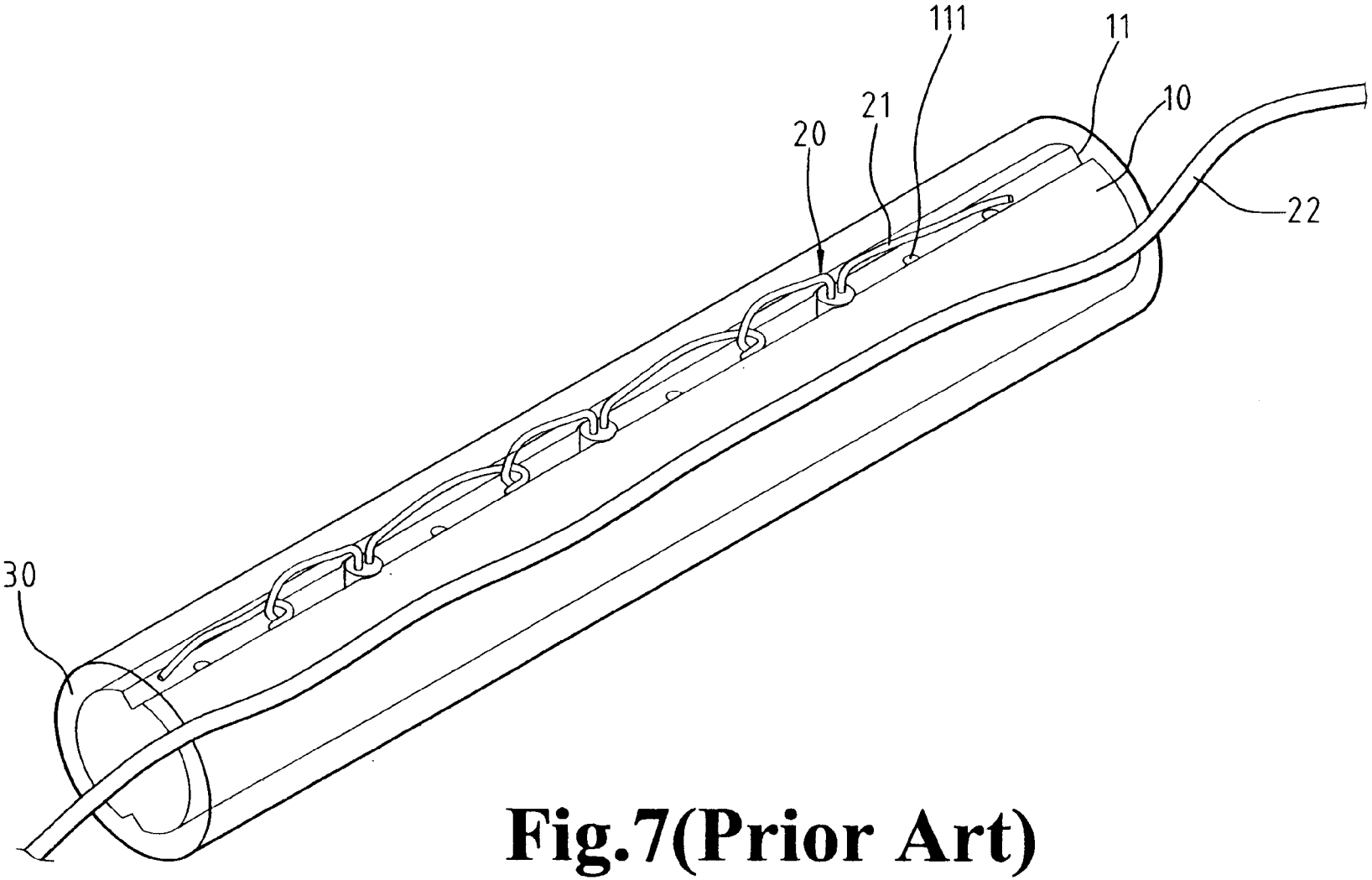
Fig.7(Prior Art)
FIG. 7 is a perspective view of a conventional tubular light.
Figure 8:
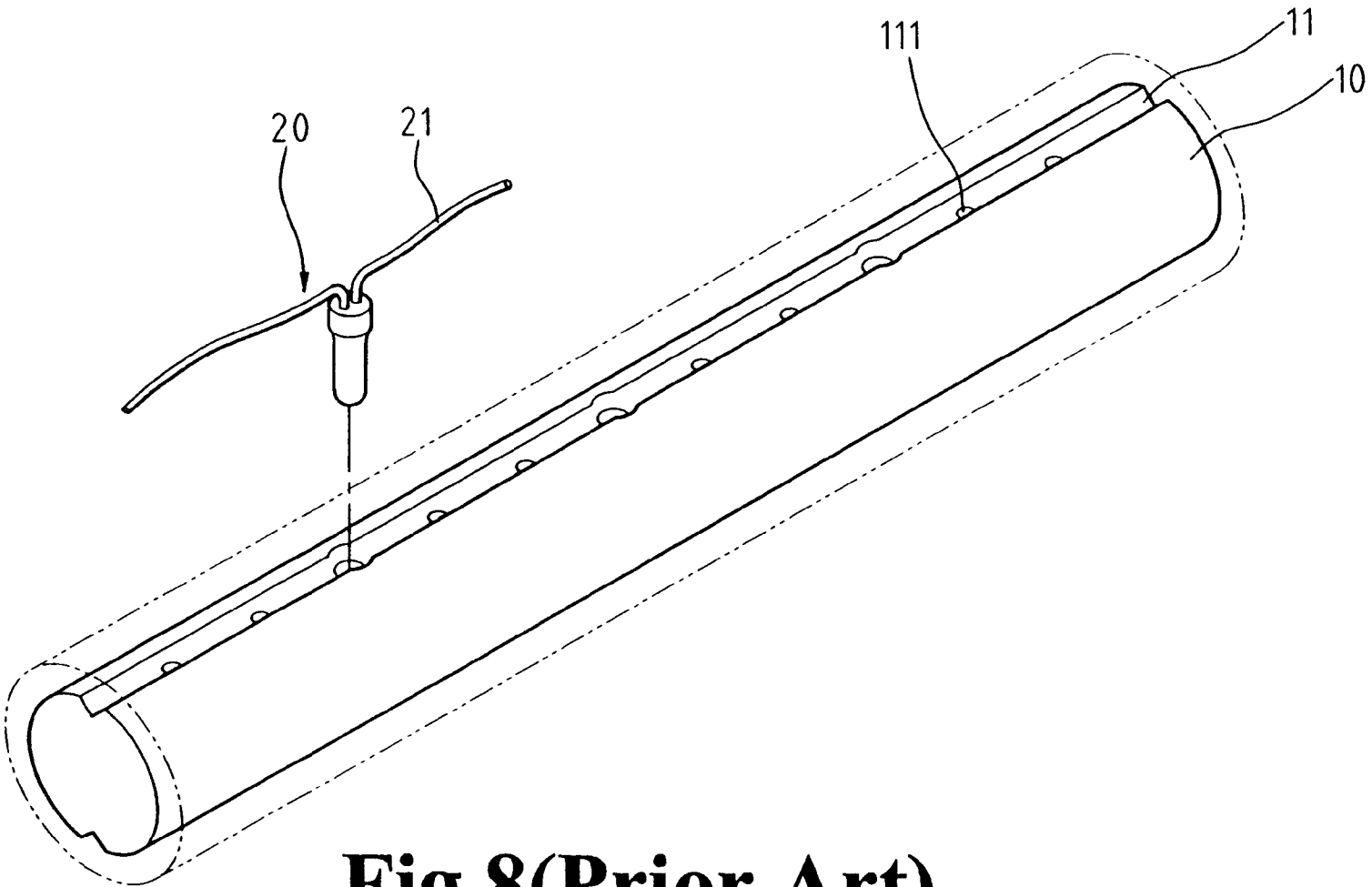
Fig.8(Prior Art)
FIG. 8 is an exploded perspective view of the tubular light of FIG. 7.

With reference to FIG. 5, a resilient element 42 made of metal is received in one of the notches 41, such that the user is able to form the tubular light into any shape required, shown in FIG. 6.

It is to be understood, however, that even though numerous characteristics and advantages of the present invention have been set forth in the foregoing description. together with details of the structure and function of the invention. the disclosure is illustrative only. and changes may be made in detail, especially in matters of shape, size, and arrangement of parts within the principles of the invention to the full extent indicated by the broad general meaning of the terms in which the appended claims are expressed.

What is claimed is:

1. A tubular light comprising:

a hollow core having a pair of opposed notches defined along the length of the core and each of the notches having a plurality of blind holes defined in a bottom defining the notch and two slits each oppositely defined in opposite sides of one of the notches;

multiple light bulbs each received in one of the blind holes with one blind hole spaced apart and having two connection wires extending toward opposite directions;

two wires each received in one of the slits and engaged with the connection wires of the light bulbs; and a casing molded outside the hollow core to cover securely the light bulbs and the core in a water tight manner;

wherein every two adjacent connection wires of two adjacent light bulbs are connected together and received in the blind hole between two adjacent light bulbs.

2. The tubular light as claimed in claim 1, wherein a periphery of the casing is polygonal.

3. The tubular light as claimed in claim 1, wherein a periphery of the casing has a continuous and undulated shape.

4. A tubular light comprising:

a hollow core having a pair of opposed notches defined along the length of the core and one of the notches having a plurality of blind holes defined in a bottom defining the notch and two slits each oppositely defined in opposite sides of one of the notches;

multiple light bulbs each received in one of the blind holes with one blind hole spaced apart and having two connection wires extending toward opposite directions;

two wires each received in one of the slits and engaged with the connection wires of the light bulbs;

a casing molded outside the hollow core to cover securely the light bulbs and the core in a water tight manner; and a resilient element received in the other notch to enable the tubular light to be formed into any shape, wherein every two adjacent connection wires of two adjacent light bulbs are connected together and received in the blind hole between two adjacent light bulbs.

5. The tubular light as claimed in claim 4, wherein a periphery of the casing is polygonal.

6. The tubular light as claimed in claim 4, wherein a periphery of the casing has a continuous and undulated shape.

* * * * *